United States Patent [19]

Banks et al.

[11] 3,945,655

[45] Mar. 23, 1976

[54] BRAKE FOR SKATEBOARD AND THE LIKE

[76] Inventors: Michael H. Banks, 317 E. LaPalma Ave., Apt. 6, Anaheim, Calif. 92801; Gilbert R. Granillo, Jr., 1780 Matchleaf Ave., LaPuente, Calif. 91745

[22] Filed: Apr. 18, 1975

[21] Appl. No.: 569,372

[52] U.S. Cl. ..... 280/11.2; 188/2 R; 188/72.7; 280/87.04 A

[51] Int. Cl.[2] ..... A63C 17/14

[58] Field of Search ..... 188/1 D, 2 R, 2 D, 17, 188/20, 71.1, 72.1, 72.7, 343; 280/11.1 BT, 11.2, 87.04 R, 87.04 A

[56] References Cited

UNITED STATES PATENTS

| | | | |
|---|---|---|---|
| 707,345 | 8/1902 | Neale | 188/72.7 |
| 885,977 | 4/1908 | Brown | 280/87.04 A |
| 1,628,559 | 5/1927 | Showers | 188/72.7 |
| 1,933,421 | 10/1933 | Elliotte | 188/2 R |
| 2,953,389 | 9/1960 | Green et al. | 280/87.04 A |
| 3,288,251 | 11/1966 | Sakiva | 280/11.2 |
| 3,385,608 | 5/1968 | Waddell | 280/11.2 |
| 3,519,285 | 7/1970 | Sullivan | 188/20 |

FOREIGN PATENTS OR APPLICATIONS

| | | | |
|---|---|---|---|
| 1,287,980 | 9/1972 | United Kingdom | 188/343 |

*Primary Examiner*—Trygve M. Blix
*Assistant Examiner*—Edward R. Kazenski
*Attorney, Agent, or Firm*—Bruce D. Jimerson

[57] ABSTRACT

The specification discloses a skateboard braking system which utilizes a cable actuated wedge to force a pair of friction shoes into contact with the rear wheel disks. The cable is operated by a footpedal which is attached to the front of the skateboard.

5 Claims, 4 Drawing Figures

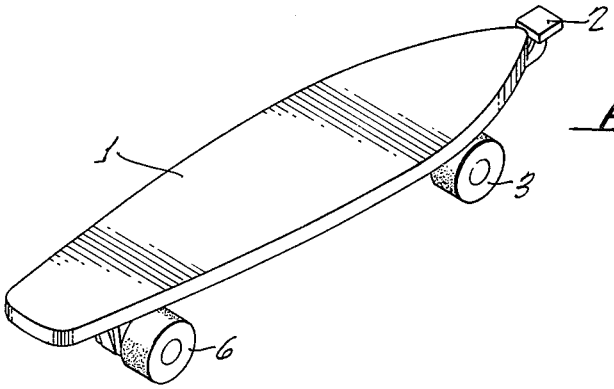
FIG. 1.
FIG. 2.
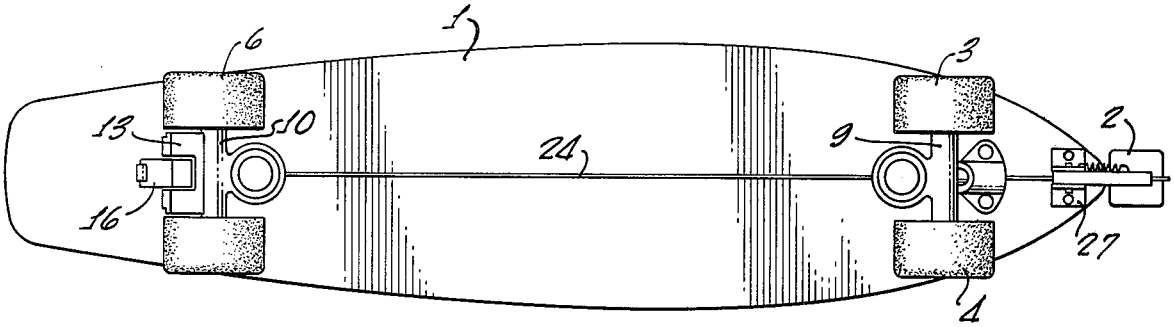
FIG. 3.
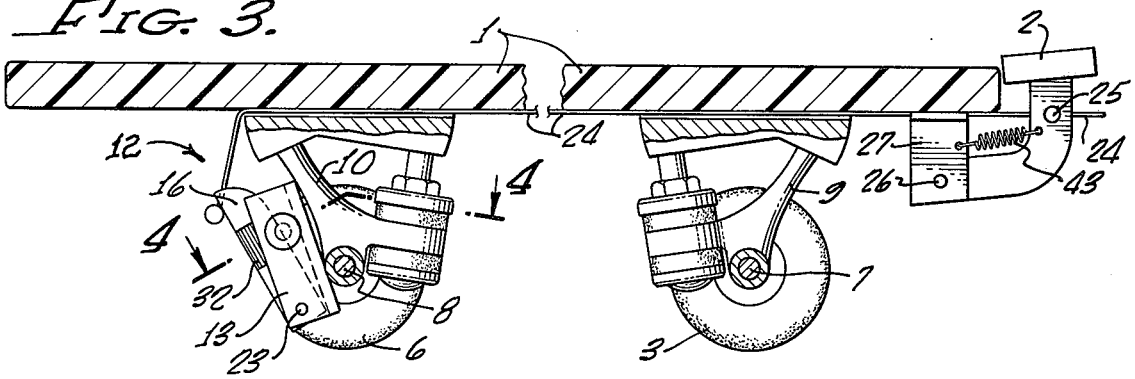
FIG. 4.
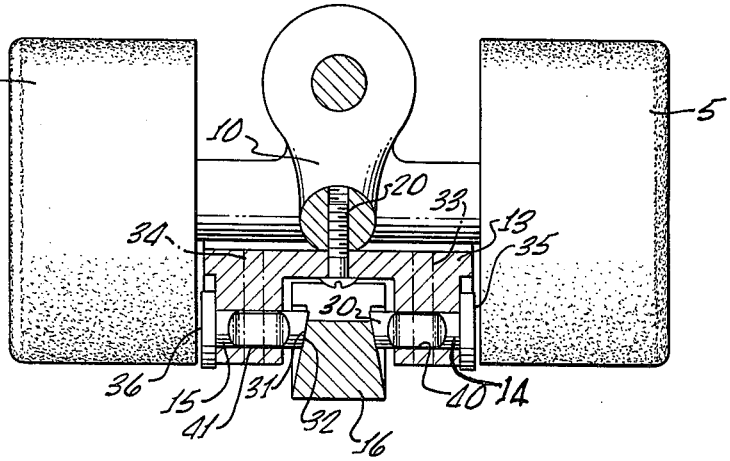

BRAKE FOR SKATEBOARD AND THE LIKE

BACKGROUND OF THE INVENTION

In recent years skateboard popularity has risen sharply. These vehicles provide thrilling recreation for amateurs as well as highly skilled competitors. The desire for increased performance has led to the manufacture of highly maneuverable boards which are capable of attaining great speeds. Associated with the increased speeds however, is the probability of serious injury, particularly since these vehicles have no brake. What is actually desired is a simple braking system which can be inexpensively incorporated within an existing skateboard design.

A further object of the present invention is to provide a brake which will operate only on the rear wheels of the vehicle (in order to prevent forward roll about the front wheel axis) should the brake be quickly applied. An additional object is to provide a convenient pedal arrangement for actuating the brake-which preferrably does not require modification of the skateboard itself.

Other objects and advantages of the present invention will be obvious from the detailed description of a preferred embodiment given herein below.

SUMMARY OF THE INVENTION

The aforementioned objects and advantages are realized by the present invention which comprises a brake housing having a pair of axially aligned cylindrical bores each of which accommodate a sliding piston. The head of each piston is fashioned to form a flat frictional braking surface, one of said surfaces being adjacent to the disk of one rear wheel and the other of said surfaces being adjacent to the disk of the other rear wheel. The inner ends of each piston rest in contact with a wedged shaped lever which is journalled about an axis parallel to the rear wheels of the skateboard. The wedge shaped lever is cable coupled to a front brake pedal so as to move each piston outwardly (to cause the frictional heads to rub against the wheel disks) when the brake pedal is depressed.

DESCRIPTION OF THE DRAWINGS

FIG. 1 shows a perspective view of the skateboard and brake pedal arrangement.

FIG. 2 shows a bottom elevation of the skateboard and braking structure.

FIG. 3 shows a side elevation of the skateboard and braking arrangement.

FIG. 4 shows a cross-section of the braking structure taken through the planes 4—4 of FIG. 3.

DETAILED DESCRIPTION OF A PREFERRED EMBODIMENT

Adverting to the drawings, FIG. 1 shows a perspective view of a conventional skateboard 1 as it would appear when modified to incorporate the braking structure which is the subject of the present invention. As shown in FIGS. 2 and 3, the skateboard is of a conventional type having two sets of wheels 3–4 and 5–6, each set being journaled about a common axis 7 and 8 respectively. Steering is accomplished in the conventional manner, the journal housings 9 and 10 being attached to the surface 1 of the skateboard via angle king pin assemblies 9 and 10 which effect rotation of axes 7 and 8 in response to a weight shift tilt of the surface 1.

Referring now to FIGS. 2, 3 and 4, a preferred embodiment of the brake comprises a footpedal 2 which is pivotally mounted (via pin 26) to the flange 27 at the front of the skateboard so as to be slightly disposed above the surface 1, and a brake assembly 12 which includes a housing 13, wedge lever 16 and oppositely disposed brake pistons 14 and 15. Housing 13 is attached to assembly 10 via screws 20; the brake pistons 14 and 15 thus maintain the same orientation with respect to the wheels 5 and 6 at all times. One end of wedge lever 16 is pivotally attached to housing 13 via a pin 23, and the other end is attached to the footpedal 2 at the point 25 via wire cable 24. The inner ends 30 and 31 of each piston (14 and 15) is beveled to correspond to the angle of the wedge surface 32 of wedge lever 16, the angular relationship between the bevels (ends 30 and 31) and wedge surface 32 being maintained by pins 33 and 34 respectively. The heads 35 and 36 of the pistons 14 and 15 are positioned adjacent to the inside disk of rear wheels. In order to achieve adequate braking surface, the diameter of the heads is larger than the bore of cylinders 40 and 41 which accommodates the body of pistons 14 and 15.

The operation of the brake can be easily understood from FIG. 3. Depression of footpedal 2 pulls cable 24 forward causing wedge lever 16 to rotate about pin 23. As a consequence the pistons 14 and 15 are driven in opposite direction by the wedge surface 32 — until the heads 35 and 36 contact the inside disk surfaces of the wheels 5 and 6 respectively. The frictional contact of the heads 35 and 36 provides a braking pressure which is proportional to the force applied to footpedal 2. Upon release, footpedal 2 is returned to its original state via spring 43. Once the footpedal pressure is removed, wedge lever 16 separates from pistons 14 and 15, allowing them to return naturally to a position of non-frictional proximity with respect to the wheels 5 and 6.

The essential components are preferably made from a durable metal such as steel — although aluminum could be used for housings and other parts if desired. The basic concept itself, while shown and described in the form of a particular embodiment, is of course, not restricted thereto, Nor are the teachings of the invention limited to skateboards — in that with only slight modifications they may be equally applicable to scooters, skeeters and other vechicles commonly used by young children. Thus, although a preferred embodiment has been shown and described, it will be understood that the invention is not limited thereto and that numerous changes, modifications and substitutions may be made without departing from the spirit of the invention.

We claim:

1. A brake for a skateboard of the type having two sets of wheels each set of which is mounted to the board by an angle king pin assembly, said brake comprising:
   - a footpedal;
   - means for attaching said footpedal to the front of the skateboard so as to position said footpedal above the skateboard surface;
   - a housing having a pair of oppositely disposed openings;
   - a piston within each of the openings in said housing;
   - means for attaching said housing to the rear wheel king pin assembly of the skateboard so as to position the head of each piston adjacent to the disk of each rear wheel;

a lever having a wedge shaped surface;

means for pivotally attaching said lever to said housing so as to position said wedge shaped surface between said pistons;

cable means for attaching said lever to said footpedal.

2. The apparatus recited in claim 1 wherein each of said pistons include a beveled end adjacent to said wedge shaped surface.

3. The apparatus recited in claim 2 wherein the openings in said housing are oppositely disposed cylindrical bores and wherein each of said pistons comprises:

a cylindrical body having a dimension adapted to slide within the cylindrical bores of said housing and a head having a surface area greater than the cross-sectional area of said body.

4. The apparatus recited in claim 3 wherein said footpedal includes:

a flat pedal surface;

a C-shaped arm attached perpendicular to said flat surface.

5. The apparatus recited in claim 4 wherein said means for attaching said footpedal to the front of the skateboard comprises:

a vertical flange mounted to the underside of the skateboard and;

means for pivotally attaching said C-shaped arm to said flange.

* * * * *